US009086050B2

(12) United States Patent
Tychsen

(10) Patent No.: US 9,086,050 B2
(45) Date of Patent: Jul. 21, 2015

(54) FLUID ROTARY MACHINE CAPABLE OF HIGH-ACCURACY DETECTION OF SHAFT ROTATION

(75) Inventor: Tom Tychsen, Graasten (DK)

(73) Assignee: Danfoss Power Solutions APS, Nordborg (DK)

( * ) Notice: Subject to any disclaimer, the term of this patent is extended or adjusted under 35 U.S.C. 154(b) by 1126 days.

(21) Appl. No.: 13/070,580

(22) Filed: Mar. 24, 2011

(65) Prior Publication Data

US 2011/0236243 A1 Sep. 29, 2011

(30) Foreign Application Priority Data

Mar. 25, 2010 (DE) ..... 10 2010 012 848

(51) Int. Cl.
*F03C 2/08* (2006.01)

(52) U.S. Cl.
CPC ..... *F03C 2/08* (2013.01); *F04C 2240/60* (2013.01); *F04C 2240/81* (2013.01); *F04C 2270/052* (2013.01); *F04C 2270/86* (2013.01)

(58) Field of Classification Search
CPC ..... B62D 15/02; G01P 1/04; F04C 2240/60
USPC ..... 60/328, 448; 73/494; 91/375 A; 180/422; 324/173; 418/181; 702/145
See application file for complete search history.

(56) References Cited

U.S. PATENT DOCUMENTS

| | | | | |
|---|---|---|---|---|
| 4,316,144 | A | 2/1982 | Levijoki | |
| 4,504,756 | A | 3/1985 | Amano et al. | |
| 4,593,555 | A | 6/1986 | Krutz et al. | |
| 5,119,898 | A * | 6/1992 | Eckhardt et al. | 180/422 |
| 5,933,795 | A | 8/1999 | Schottler et al. | |
| 6,062,123 | A | 5/2000 | Obata et al. | |
| 6,539,710 | B2 | 4/2003 | Draper | |
| 7,676,309 | B2 * | 3/2010 | Tamaki et al. | 701/41 |
| 8,554,411 | B2 * | 10/2013 | Ura | 701/41 |
| 2003/0042064 | A1 * | 3/2003 | Takekawa et al. | 180/444 |
| 2011/0186758 | A1 | 8/2011 | Goldbeck et al. | |

FOREIGN PATENT DOCUMENTS

| | | | |
|---|---|---|---|
| DE | 3912277 | A1 | 10/1990 |
| DE | 19547537 | C1 | 2/1997 |
| DE | 19824926 | A1 | 12/1999 |
| DE | 102004060198 | B3 | 3/2006 |
| DE | 102005036483 | B4 | 1/2008 |
| EP | 1231128 | A2 | 8/2002 |
| WO | 9967650 | A1 | 12/1999 |

* cited by examiner

*Primary Examiner* — Hezron E Williams
*Assistant Examiner* — David Z Huang
(74) *Attorney, Agent, or Firm* — McCormick, Paulding & Huber LLP

(57) ABSTRACT

The invention concerns a fluid rotary machine (1) with a housing (2), a shaft (3) projecting from the housing (2), and being rotatable around an axis (4) and forming part of a movement chain, and a sensor arrangement (10) comprising a transmitter (12) and a receiver (15). It is endeavored to find a simple solution for detecting the rotation of the shaft with a relatively high accuracy. For this purpose, a channel (21) is provided in the movement chain, and the transmitter (12) is connected to a transfer element (19) transferring a torque that is led through said channel (21) to a section of the movement chain that is farther away from the transmitter (12) than a transmitter-side end of the movement chain.

12 Claims, 3 Drawing Sheets

B
C
C
2
3
4
5
6
7
8
9
10
11
12
13
14
17
19
20
22
23

FLUID ROTARY MACHINE CAPABLE OF HIGH-ACCURACY DETECTION OF SHAFT ROTATION

CROSS REFERENCE TO RELATED APPLICATIONS

Applicant hereby claims foreign priority benefits under U.S.C. §119 from German Patent Application No. 10 2010 012 848.1 filed on Mar. 25, 2010, the contents of which are incorporated by reference herein.

TECHNICAL FIELD

The invention concerns a fluid rotary machine with a housing, a shaft projecting from the housing, being rotatable around an axis and forming part of a movement chain, and a sensor arrangement comprising a transmitter and a receiver.

BACKGROUND OF THE INVENTION

Such a machine is known from U.S. Pat. No. 6,539,710 B2. The first section shows an externally toothed gear wheel that interacts with an internally toothed ring. Pressure pockets are formed between the gear wheel and the ring, said pressure pockets being either supplied with pressure fluid or connected to a low-pressure area via a rotary valve slide arrangement. The gear wheel is connected to the shaft via a cardan shaft. The gear wheel engages a crank pin that transmits the orbiting movement of the gear wheel to a sensor shaft.

U.S. Pat. No. 4,593,555 describes a hydraulic engine in which a pressure sensor is used to detect the rotation speed of the shaft.

U.S. Pat. No. 6,062,123 describes an auxiliary force supported steering arrangement with an engine and a sensor that detects a position of a steering handwheel. The sensor is arranged to be radial to the axis of the steering handwheel shaft.

DE 198 24 926 C2 describes a further hydraulic steering arrangement, in which a front side of an inner control slide is provided with a row of teeth which can be detected by a sensor.

DE 10 2005 036 483 B4 describes a hydraulic rotary machine, whose shaft is provided with a transmitter, whose circumference comprises a toothed structure with teeth and grooves. In the housing is arranged a transmitter that directs a light beam towards the threaded structure. From the threaded structure the light beam is reflected to a receiver.

In many application fields for such machines, in particular hydraulic rotary machines, sensors are required to enable steering of the machine with sufficient accuracy, for example in connection with a connected diesel engine, in order to save energy.

The sensor arrangements in the machines mentioned in the introduction have proved their worth. However, frequently a relatively complicated integration of the sensor is required. The sensor will then often be in a position, in which it is actually disturbed. If the sensor is arranged in a position, in which it is disturbed less, the problem occurs that it cannot directly detect the rotation of the shaft, but is connected to the shaft via several engagement points which are causing slack. A similar problem occurs, when the shaft can get twisted, for example because of large torques inside the movement chain.

SUMMARY OF THE INVENTION

The invention is based on the task of providing a simple opportunity of detecting the rotation of the shaft with a relatively high accuracy.

With a fluid rotary machine as mentioned in the introduction, this task is solved in that a channel is provided in the movement chain, and the transmitter is connected to a transfer element transferring a torque that is led through said channel to a section of the movement chain that is farther away from the transmitter than a transmitter-side end of the movement chain.

With this embodiment, the sensor can be arranged at a position, where it is practically not disturbed, namely at a front side of the machine. The rotation of the shaft is then transferred to the transmitter by means of the transfer element. The rotation of the shaft can then be detected at a section of the movement chain, that is, transferred to the transfer element, which is arranged closer to the section of the shaft projecting from the housing. Thus, the section of the movement chain, at which errors can occur, has been reduced.

Preferably, the movement chain has at least a first section and a second section, the first section and the second section engaging each other via an engagement point and the torque transfer element bridging the engagement point. In many cases, it is necessary to make the movement chain of two or more sections and to connect these sections via an engagement point, which could also be called joint or connection. In practice, such an engagement point cannot be made without play. This is particularly the case, when the engagement point is formed by a toothed geometry. When the transfer element bridges such an engagement point, the error occurring here because of the play can be eliminated.

In a preferred embodiment, the first section orbits around the axis. The orbiting movement of the first section of the movement chain and the related play in the movement chain are not important any more, as the transfer element is led through the channel to the second section. In this connection, the transfer element can be led into the second section. In some cases, however, it is sufficient to connect the transfer element to a part of the movement chain that rotates synchronously with the second section. Thus, at least an inaccuracy can be avoided that originates from a conversion of the orbiting movement into a rotary movement and the related play. On the contrary, the rotary movement is transferred directly to the transmitter of the sensor arrangement.

Preferably, the first section rotates with the same speed as the second section. Thus, the first section does not only orbit, it also rotates. As it rotates with the same speed as the second section, there is no relative rotation between the transfer element and the inner wall of the channel in the first section. Thus, when the clear cross-section of the channel is not large enough anyway, the transfer element is only stressed by a bending. Otherwise there will be no loads on the transfer element.

Preferably, the transfer element is made as speedometer cable. A speedometer cable also transfers a rotary movement, when it is bent as far as possible. A speedometer cable has a high torsion rigidity, so that the transfer of the movement from one end to the other of the transfer element can take place with a high accuracy.

Preferably, the transfer element is connected to the second section and/or the transmitter in an unrotatable, but longitudinally displaceable manner. Thus, it is permitted that the transfer element expands or contracts, which may for example happen under the influence of the temperature inside the machine. Such a connection can, for example, be realised in that the transfer element has a polygon-like cross-section at one end, which is inserted in an opening in the second section and/or in the transmitter, said opening having a corresponding polygon-like shape.

Preferably, the transfer element has a maximum distortion that is smaller than the sum of the plays in all engagement points of the movement chain, which are bridged by the transfer element. In this connection, it is particularly advantageous that the transmitter in the sensor arrangement requires almost no torque to be rotated. Thus, only an extremely small difference between the torques at both ends of the transfer element occurs. The risk that an angle deviation between the two ends of the transfer element will occur during a rotation of the second section is thus very small. As opposed to this, a deviation will practically always occur in a connection between sections of the movement chain, which are, for example, formed by the engagement of two toothings; as such an engagement can practically not be made in without play.

Preferably, the transfer element is connected to the shaft. In this case, the rotary movement of the shaft is transferred directly to the transmitter of the sensor arrangement, so that the rotary movement of the shaft can be detected with a higher accuracy.

Preferably, the sensor arrangement has a sensor housing with an accommodation chamber for the transmitter, the accommodation chamber being in fluid connection with the inside of the housing and sealed towards the outside, the receiver being arranged outside the sensor housing. Such an embodiment of the sensor arrangement can also be used with other fluid machines, which are not provided with a transfer element as described above. Such a sensor arrangement is not only for use with machines, in which a part of the movement section orbits.

In an advantageous manner it is utilised here that the sensor housing seals the inside of the machine towards the outside, so that with the sensor arrangement no opening is required, through which a moving element is guided, which then has to be sealed. If a sealing between moving elements can be saved, this increases the operational safety. The wear remains small and the error susceptibility is reduced. If, for example, the sensor arrangement is connected to a hydraulic machine, hydraulic fluid can penetrate into the accommodation chamber, thus at the same time lubricating contact faces between the sensor housing and the transmitter. This again causes that the transmitter can rotate practically freely in the sensor housing, so that an extremely small torque is required to rotate the transmitter. When using a transfer element, this again keeps the distortion of the transfer element very small.

Preferably, the transmitter comprises a support element that interacts unfrictionally with the sensor housing. In this case, the sensor arrangement can also be used when the liquid or the fluid that penetrates into the accommodation chamber has no lubricating effect, which is for example the case with water-hydraulic machines.

Preferably, the sensor housing is screwed into a front cover of the machine. For this purpose, the sensor housing has, for example, an outer thread that engages a corresponding inner thread in the front cover. This simplifies the manufacturing of the sensor housing and the mounting of the sensor arrangement on the machine. Further, with this embodiment it is relatively simple to seal the accommodation chamber towards the outside. A sealing simply has to be arranged between the sensor housing and the front cover and the sensor housing must be screwed into the front cover with the sufficient force.

Preferably, the receiver is clamped onto the sensor housing. Thus, the receiver is connected to the sensor housing by means of a detachable connection that can be made and detached again relatively quickly. This has the advantage that by replacing the receiver, the machine can relatively easily be provided with different kinds of sensor arrangements. Also repair work is simplified. In a sensor arrangement the receiver is usually the most fault-susceptible part.

BRIEF DESCRIPTION OF THE DRAWINGS

In the following, the invention is explained on the basis of preferred embodiments in connection with the drawings, showing.

DETAILED DESCRIPTION OF THE PREFERRED EMBODIMENT

In the following, the invention is explained on the basis of a hydraulic engine as example of a fluid rotary machine. However, the invention is not limited to hydraulic engines.

Figure 1:
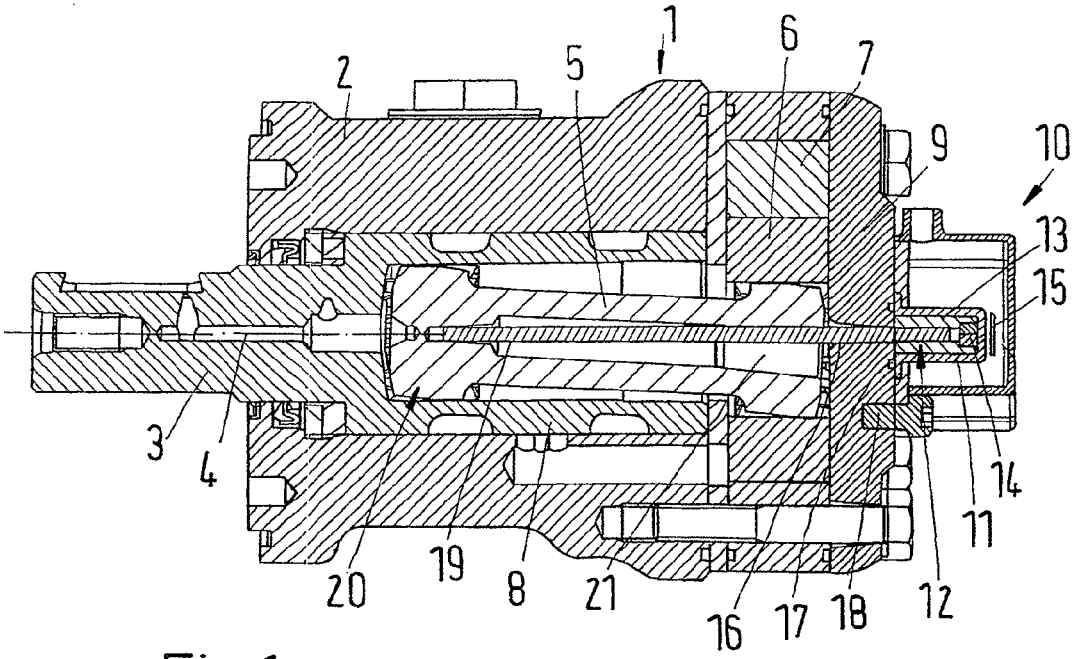
FIG. 1 is a hydraulic engine as an example of a fluid rotary machine.

A hydraulic engine as shown in FIG. 1 comprises a housing 2 and a shaft 3 that projects from said housing 2. A mechanical output can be collected from the shaft 3.

The shaft 3 is rotatable around an axis 4. The shaft 3 forms part of a movement chain that also comprises a cardan shaft 5 and an externally toothed gear wheel 6 that is arranged in an internally toothed ring 7 to form pressure pockets as known per se, which can, in dependence of their position, be supplied with hydraulic fluid under pressure or release hydraulic fluid to a low-pressure connection. For the control of the fluid supply to these pressure pockets a schematically shown control slide 8 is provided that is connected to the shaft 3.

Thus, with the gear wheel 6, the movement chain has a first section that orbits around the axis 4. Further, in the area of the shaft 3, the movement chain has a second section that rotates around the axis 4.

On the side opposite the shaft, the housing 2 is closed by a front cover 9. A sensor arrangement 10 is arranged on the outside of the front cover 9. The sensor arrangement 10 is supposed to detect the rotation of the shaft 3 as accurately as possible.

The sensor arrangement 10 comprises a sensor housing 11 that surrounds an accommodation chamber, in which a transmitter 12 is arranged. The transmitter 12 comprises a support element 13 that is formed of a material, which interacts unfrictionally with the material of the sensor housing 11. One or more transmitter elements is/are arranged on the support element. In the present embodiment, the transmitter elements 14 are made as permanent magnets. On the outside of the sensor housing 11 is arranged a receiver 15 that is acted upon by the magnetic field of the transmitter elements 14, and which passes on electrical signals containing the information about the rotary movement of the shaft 3, either through a line that is not shown in detail or wirelessly, to a control that is not shown in detail.

The front cover 9 has a centrally arranged through opening 16. Via the through opening 16, the inside of the housing 2 is in contact with the accommodation chamber of the sensor housing 11, so that hydraulic fluid from the inside of the housing 2 can also penetrate into the inside of the sensor housing 11. Between the sensor housing 11 and the front cover 9 is arranged a sealing 17, so that the hydraulic fluid cannot penetrate to the outside. The required sealing forces are provided by a fixing arrangement, with which the sensor housing 11 is fixed to the front cover 9. Here, this fixing arrangement is symbolised by a screw 18. In practice, several screws 18 are provided.

The sensor housing 11 is made of a material that is non-magnetic and permits passage of the magnetic field from the transmitter elements 14, so that this magnetic field can be detected by the receiver 15.

Via a transfer element 19, the support element 13 is connected to a second section of the movement chain that rotates around the axis 4. This is the end of the cardan shaft 5 that engages the shaft 3 via a toothed geometry 20.

The transfer element 19 is formed as a speedometer cable, that is, it is torsionally rigid. The driving of the transmitter 12, which is additionally lubricated by the hydraulic fluid in the sensor housing 11, requires practically no torque, so that the transfer element 19 is practically not stressed by torsion. Thus, with a high accuracy, the transmitter 12 has always exactly the same rotation angle position as the shaft 3. The deviation is maximum 5°, preferably even only maximum 2° and in particularly preferred cases maximum 1°.

In order that the transfer element 19 can be led to the transmitter 12, the cardan shaft comprises a channel 21 that also passes through the first section of the movement chain. In this connection, this channel 21 can also be called "longitudinal channel", as it passes through at least a part of the movement chain in the longitudinal direction. The gear wheel 6 turns with the same speed as the cardan shaft 5 and thus with the same speed as the transfer element 19. In the channel 21 there will thus not be any relative movement between the transfer element 19 and the cardan shaft 5 in the rotation direction. If the diameter of the channel 21 is too small to permit the transfer element 19 the necessary free space over a full rotation, the transfer element 19 will be exposed to a bending movement, which is, however, uncritical.

Instead of a speedometer cable, also another transfer element can be used, for example a thin metal stick or the like.

In certain cases, the embodiment according to FIG. 1 will experience a deviation between the angle position of the shaft 3 and the angle position of the transmitter 12 caused by a play in the toothing geometry 20.

Figure 2:
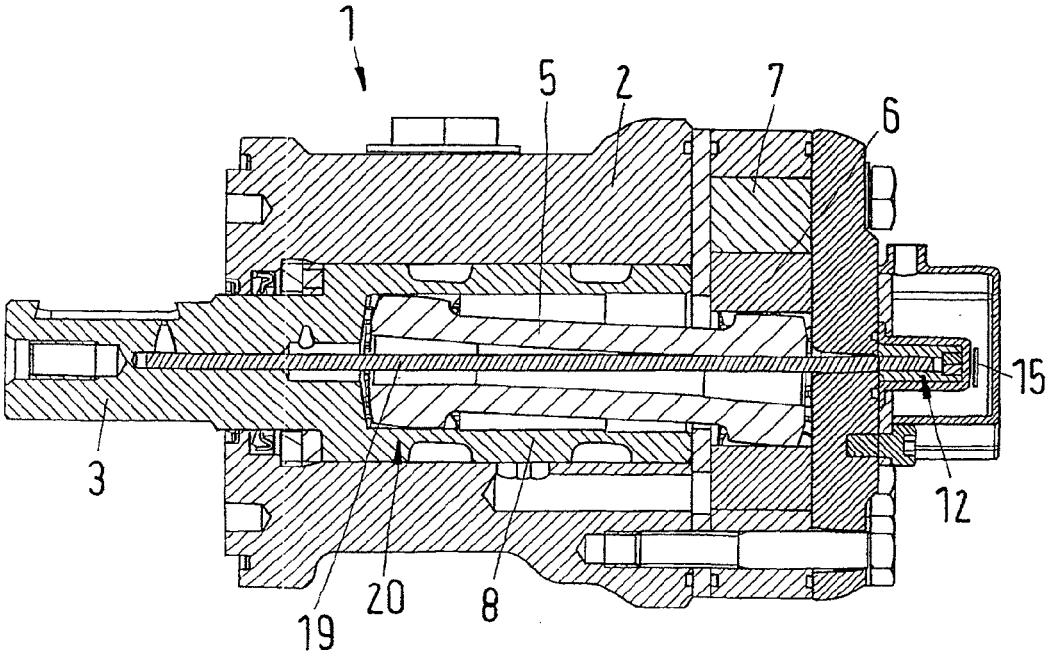
FIG. 2 is a second embodiment of a hydraulic engine.

In order to remedy this deviation, an embodiment as shown in FIG. 2 can be used. Here, the same elements are provided with the same reference signs.

The transfer element 19 is made longer than in the embodiment according to FIG. 1, so that it can be fixed directly in the shaft 3. Then, a possible play in the toothing geometry 20 will no longer have any influence.

In both cases, the transfer element 19 is unrotatably connected to the transmitter 12 and/or the shaft 3, however, being displaceable in a direction parallel to the axis 4. This can, for example, be achieved in that the ends of the transfer element 19 have a polygon-like cross-section, for example in the shape of a square. These ends of the transfer element 19 are then led into corresponding openings in the transmitter 12 and/or the shaft 3, said openings having a corresponding polygon-like cross-section. Thus, to a certain degree, the ends can be axially displaced into the openings, so that a longitudinal change of the transfer element can be accommodated, which could, for example, occur because of a temperature change.

FIG. 3 shows a further hydraulic machine. The same elements as in FIGS. 1 and 2 have the same reference signs.

Also here, the shaft 3 is connected via a toothing geometry 20 to the cardan shaft 5, which again is connected via a second toothing geometry 22 to the gear wheel 6. A second cardan shaft 23 is provided to connect the gear wheel 6 to the valve slide 8 that rotates together with the shaft 3 in order to fill hydraulic fluid from the right position into the pressure pockets formed between the gear wheel 6 and the toothed ring 7.

One end of the transfer element 19 is connected to the shaft 3 and the other end to the transmitter 12. Accordingly, with a high accuracy, the transmitter 12 has the same angle position as the shaft 3. Play in the toothing geometries 20, 22 has no influence here.

Figures 3A, 3B, 3C:
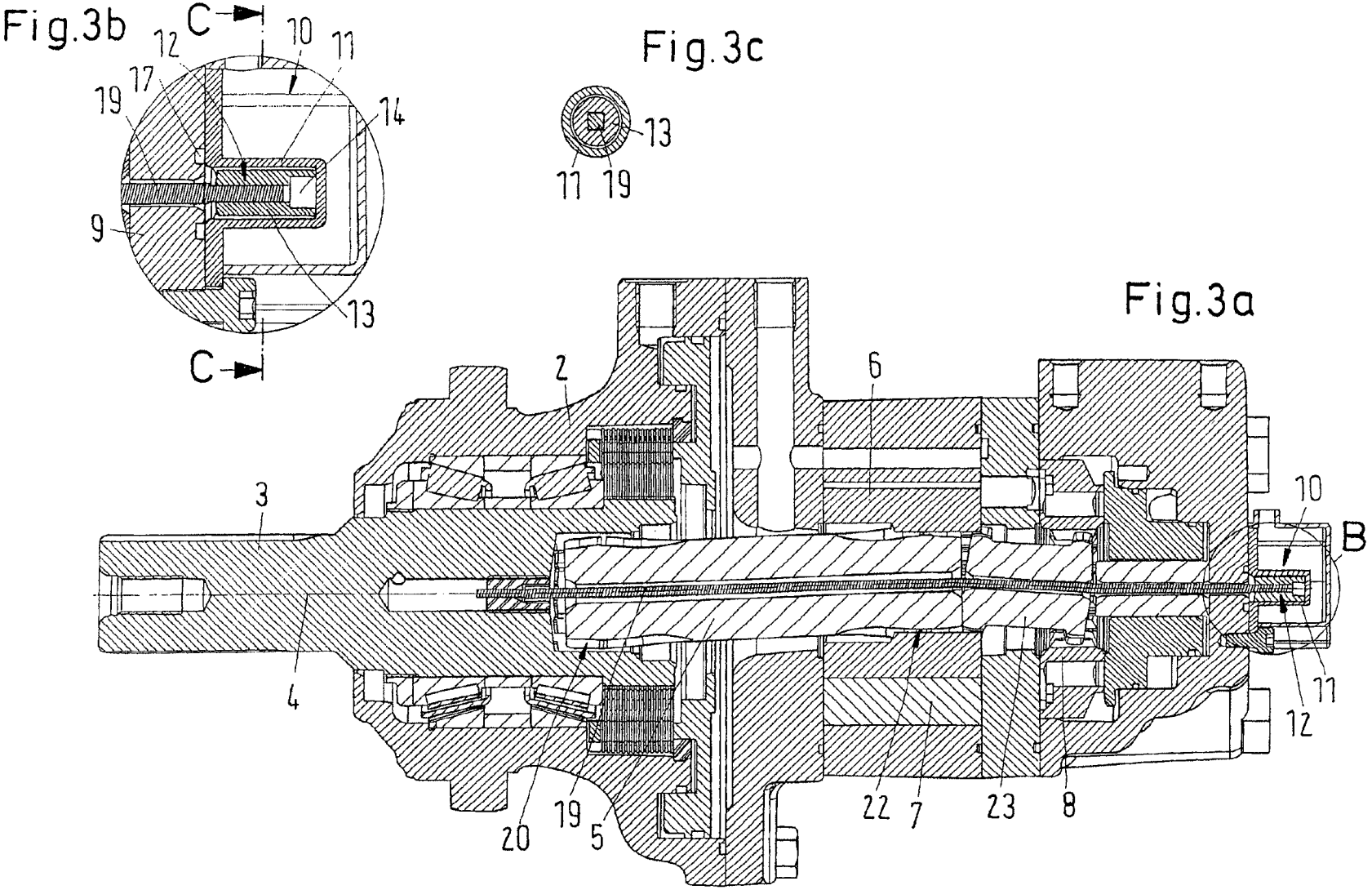
FIG. 3*a*-3*c* are a third embodiment of a hydraulic engine.

FIG. 3*b* is an enlarged view of a detail B in FIG. 3*a*, namely the sensor arrangement 10. FIG. 3*b* shows a section C-C according to FIG. 3*c*. From that it appears that the end of the transfer element 19 that is accommodated in the support element 13 has a square cross-section and the support element 13 has a corresponding opening.

The sensor housing 11 is, for example, made of stainless steel and the support element 13 of a plastic material, preferably PEEK (polyetheretherketone).

Instead of magnets, other elements can be used as transmitter elements 14.

If, for example, the sensor housing 11 is penetrable of a radiation, for example an optical radiation, the transmitter element 14 can also comprise an optical marking that can be detected from the outside through the sensor housing 11. The radiation does not necessarily have to be a visible radiation. Possible is also the use of a radiation in the infrared or ultraviolet range. If they are able to penetrate the sensor housing 11, also other electromagnetic waves can be used for the signal transmission from the transmitter 12 to the outside.

The sensor housing 11 is sealed in relation to the front cover 9 by means of the sealing 17. Accordingly, hydraulic fluid can still penetrate into the inside of the sensor housing 11, but not to the outside. The sensor housing 11 is dimensioned so that it can adopt pressures occurring inside the housing 2. However, sealings are not required to seal moving parts in relation to each other in the area of the sensor arrangement 10.

Figure 4A:
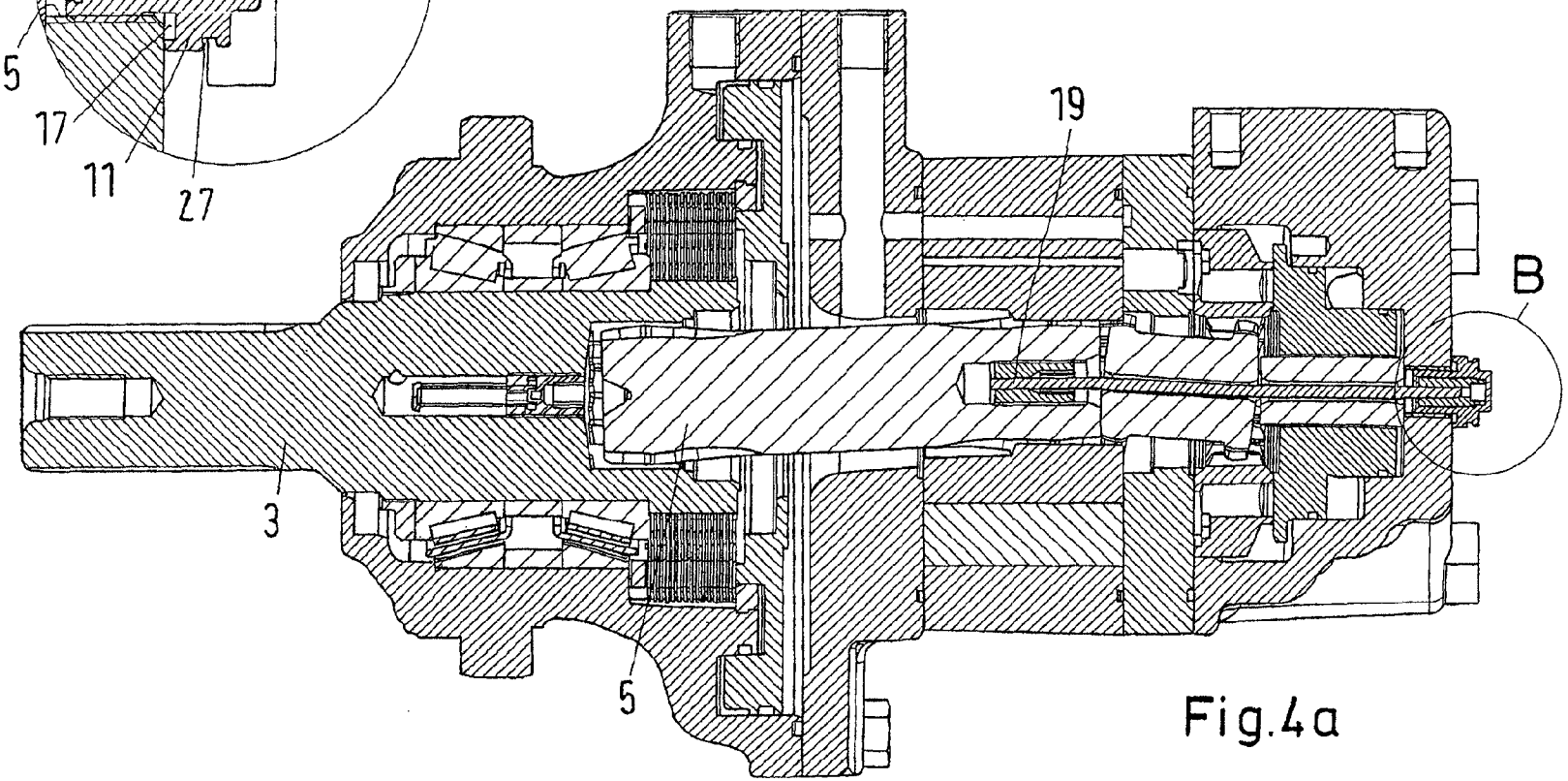
FIG. 4*a*, 4*b* are a fourth embodiment of a hydraulic engine.

FIG. 4*a* shows an embodiment very much like the one in FIG. 3*a*. The same elements have the same reference signs.

Substantially, two changes appear:

Firstly, the transfer element 19 is connected to the cardan shaft 5 at the end facing away from the shaft 3. Thus, in this area the transfer element 19 is arranged eccentrically. However, the knowledge is utilised that the cardan shaft 5 rotates with the same speed as the shaft 3, and it is therefore basically insignificant, whether the transfer element 19 is fixed to a rotating and orbiting section of the cardan shaft 5, as in FIG. 1, or to a merely rotating section of the cardan shaft 5. The only condition is that during operation the transfer element 19 is only stressed by bending to an extent that it can manage at length.

Figure 4B:
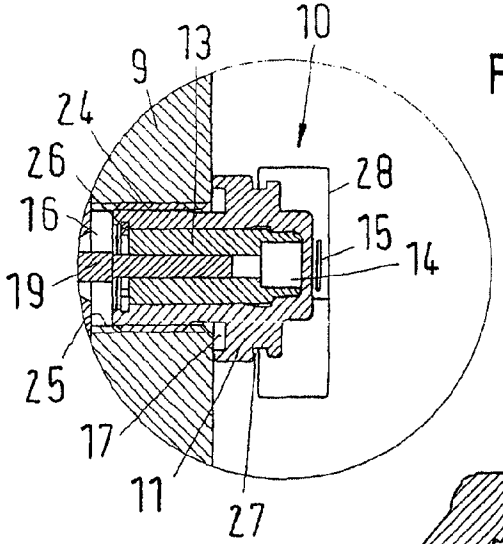

A second difference concerns the sensor arrangement 10 that is shown in an enlarged view in FIG. 4*b*.

The sensor housing 11 has an outer thread 24 that is screwed into an inner thread 25 in the through opening 16 in the front cover 9. This simplifies both the manufacturing of the sensor housing 11 and the mounting of the sensor housing 11. The sensor housing 11 can be made as a turned part. The mounting simply occurs in that the sensor housing 11 is screwed into the front cover 9, this screw mounting making the sealing 17 seal between the front cover 9 and the sensor housing 11.

The support element 13 is held in the sensor housing 11 by means of a lock ring 26. The transfer element 19 projects through the front cover 9, so that the support element 13 that is premounted in the sensor housing 11 can be fitted on the transfer element 19 before the sensor housing 11 is screwed into the front cover 9.

The sensor housing 11 has a groove 27 on its outer circumference. A clamp 28, only shown schematically, is inserted in the groove 27. This clamp 28 fixes the receiver 15 on the front side of the sensor housing 11. In this way, the receiver 15 is easily mounted, but also easily replaced.

While the present invention has been illustrated and described with respect to a particular embodiment thereof, it should be appreciated by those of ordinary skill in the art that various modifications to this invention may be made without departing from the spirit and scope of the present.

What is claimed is:

1. A fluid rotary machine with a housing, a shaft projecting from the housing, being rotatable around an axis and forming part of a movement chain, and a sensor arrangement comprising a transmitter and a receiver, wherein a channel is provided in the movement chain, and the transmitter is connected to a transfer element transferring a torque that is led through said channel to a section of the movement chain;

wherein the transmitter is connected to the transfer element such that the transmitter is closer to one end of the movement chain than the other end of the movement chain; and wherein the section of the movement chain that the transfer element transfers a torque to is farther away from the transmitter than a transmitter-side end of the movement chain.

2. The rotary machine according to claim 1, wherein the movement chain has at least a first section and a second section, the first section and the second section engaging each other via an engagement point and the transfer element bridging the engagement point.

3. The rotary machine according to claim 2, wherein the first section orbits around the axis.

4. The rotary machine according to claim 3, wherein the first section rotates with the same speed as the second section.

5. The rotary machine according to claim 1, wherein the transfer element is made as speedometer cable.

6. The rotary machine according to claim 1, wherein the transfer element is connected to the second section and/or the transmitter in an unrotatable, but longitudinally displaceable manner.

7. The rotary machine according to claim 1, wherein the transfer element has a maximum distortion that is smaller than the sum of the plays in all engagement points of the movement chain, which are bridged by the transfer element.

8. The rotary machine according to claim 1, wherein the transfer element is connected to the shaft.

9. The rotary machine according to claim 1, wherein the sensor arrangement has a sensor housing with an accommodation chamber for the transmitter, the accommodation chamber being in fluid connection with the inside of the housing and sealed towards the outside, the receiver being arranged outside the sensor housing.

10. The rotary machine according to claim 9, wherein the sensor housing is screwed into a front cover of the machine.

11. The rotary machine according to claim 9, wherein the receiver is clamped onto the sensor housing.

12. A fluid rotary machine comprising:

a housing;

a shaft projecting from the housing and being rotatable around a longitudinal axis and forming part of a movement chain;

a transfer element transferring torque from a section of the movement chain through a connection to the shaft such that the transfer element rotates together with the shaft to have the same rotational position as the shaft; and a sensor arrangement disposed at an end of the movement chain opposite the shaft, the sensor arrangement comprising a transmitter connected to the transfer element and a receiver;

wherein the section of the movement chain from which the torque is transferred is farther away from the transmitter than the end of the movement chain where the sensor arrangement is disposed.

* * * * *